US005234726A

United States Patent [19]

Dahan

[11] Patent Number: 5,234,726

[45] Date of Patent: Aug. 10, 1993

[54] GIFT WRAP MATERIAL PROVIDED WITH INFLATABLE BALLOONS

[76] Inventor: David Dahan, 145 S. Montgomery St., Valley Stream, N.Y. 11580

[21] Appl. No.: 787,400

[22] Filed: Nov. 4, 1991

[51] Int. Cl.[5] ..... A63H 27/10

[52] U.S. Cl. ..... 428/9; 229/923; 428/12; 428/43; 446/220

[58] Field of Search ..... 428/7, 12, 9, 43; 446/220, 221; 229/923; 116/210

[56] References Cited

U.S. PATENT DOCUMENTS

| | | | |
|---|---|---|---|
| 4,416,433 | 11/1983 | Bellina | 116/210 X |
| 4,758,198 | 7/1988 | Ishiwa | 446/220 |
| 4,857,029 | 8/1989 | Dierick et al. | 446/220 |
| 4,901,664 | 2/1990 | Labrecque | 446/220 X |
| 4,903,958 | 2/1990 | DiCarlo et al. | 116/210 X |
| 4,920,674 | 5/1990 | Shaeffer | 40/214 X |
| 4,944,242 | 7/1990 | Russell | 116/210 |
| 5,004,633 | 4/1991 | Lovik | 446/221 X |
| 5,083,771 | 1/1992 | Tyner | 40/412 X |

*Primary Examiner*—Henry F. Epstein
*Attorney, Agent, or Firm*—Goodman & Teitelbaum

[57] ABSTRACT

A gift wrap material for wrapping boxes, packages and the like, including a sheet of material having scored lines, a tray-like member disposed against an underside portion of the sheet, the tray-like member having at least first and second recesses therein with the first recess being disposed under the scored lines. At least one balloon, preferably four ballons with one ballon being larger than the other three balloons, is disposed in the first recess in a deflated condition, a compressed air or helium tank for inflating the balloon or balloons is disposed in the second recess, and a valve member for releasing the compressed air or helium from the tank is also disposed in the second recess so that the tank can be released to inflate the balloon or balloons. A string is connected to the valve member for actuation thereof, and extends through an opening in the sheet so that when a person pulls on the string, the valve member releases the tank to permit the inflation of the balloon or balloons which then break through the sheet at the scored lines when being inflated, where the balloon or balloons become fully inflated on an outer side of the sheet. Preferably, the tray-like member is positioned on a box cover so that the first and second recesses of the tray-like member are inserted into a cut out formed in the box cover.

19 Claims, 2 Drawing Sheets

GIFT WRAP MATERIAL PROVIDED WITH INFLATABLE BALLOONS

BACKGROUND OF THE INVENTION

The invention relates to gift wrap material for wrapping boxes, packages and the like, and more particularly, to gift wrap material provided with inflatable balloons which are concealed under the gift wrap material so that the receiver of the gift wrapped box or package is pleasantly surprised when the balloons break through the gift wrap material as the balloons are being inflated.

There are many occasions when a person receives a gift wrapped box, package and the like, such as for birthdays, anniversaries, graduations, etc. Accordingly, the present invention offers a pleasant surprise for the receiver thereof. When the receiver activates the inflation of the balloons which are disposed under the gift wrap material, such as by pulling a tag attached to the end of a string extending outwardly from the gift wrap material, the balloons break through the gift wrap material until the balloons are fully inflated on the outside of the gift wrapped box or package. The balloons can have printing or drawings thereon, such as "Happy Birthday", "Happy Anniversary", "Happy Graduation" and the like.

It is well known in the prior art to provide containers having an inflatable balloon therein. U.S. Pat. No. 4,903,958 discloses an amusement device constructed to simulate a gift package, e.g. for a birthday, or for Christmas, where the package is subdivided into a compressed air chamber and a balloon storage compartment so that when a person receiving the gift package attempts to open it, the balloon is automatically inflated so as to pop out of the package.

U.S. Pat. No. 4,920,674 discloses a cylinder type birthday gift provided with an inflatable balloon therein, a device for inflating the balloon, and an audible communication device for providing a message upon inflation of the balloon.

U.S. Pat. No. 4,758,198 discloses a container in the shape of an egg having an inflatable balloon therein where the balloon is filled by a gas formed by chemicals contained within the balloon.

U.S. Pat. No. 4,416,433 discloses a self-contained signal balloon dispensing apparatus wherein the balloon is inflated by a trigger mechanism.

U.S. Pat. No. 4,944,242 discloses a kit including a container which holds an inflatable rescue balloon therein together with a pressure vessel for inflating the balloon.

In the above prior art patents, the containers are used merely to house the inflatable balloon and the apparatus necessary to inflate the balloon, where none of the prior art containers have any gifts or presents therein. Accordingly, there is presently a need for a gift wrap material provided with inflatable balloons which can be used to wrap a gift box or package containing a gift or present therein which offers a pleasant surprise for the receiver thereof.

SUMMMARY OF THE INVENTION

It is accordingly an object of the present invention to provide a gift wrap material for wrapping boxes, packages and the like which avoids the problems of the prior art devices.

Another object of the present invention is to provide a gift wrap material for wrapping boxes, packages and the like which can be used for different occasions, such as birthdays, anniversaries, graduations, etc.

A further object of the present invention is to provide a gift wrap material for wrapping boxes, packages and the like provided with inflatable ballons which are concealed under the gift wrap material so that the receiver of the gift wrapped box or package is pleasantly surprised when the balloons break through the sheet of material as the ballons are being inflated.

Still another object of the present invention is to provide a gift wrap material for wrapping boxes, packages and the like which includes a sheet of material secured over a tray-like member containing inflatable balloons therein and means for inflating the ballons, which are assembled together to form a unitary structure for easily wrapping the gift box or package.

Another object of the present invention is to provide a gift wrap material for wrapping boxes, packages and the like as described above, wherein the tray-like member is disposed on a box cover with portions of the tray-like member being inserted into a cut out formed in the box cover.

Briefly, in accordance with the present invention, there is provided a gift wrap material for wrapping boxes, packages and the like, including a sheet of material having scored lines and an opening therein, a tray-like member disposed against an underside portion of the sheet, the tray-like member having at least first and second recesses therein, the first recess being disposed under the scored lines, and the second recess being disposed under the opening.

At least one balloon, preferably four balloons with one balloon being larger than the other three balloons, is disposed in the first recess in a deflated condition. First means such as a compressed air or helium tank for inflating the balloon or balloons is disposed in the second recess with the balloon or balloons being in flow communication with the first means. Second means such as a valve member for releasing the first means is also disposed in the second recess so that the first means can be released to inflate the balloon or balloons. Actuation means such as a string is connected to the second means and extends from the second recess through the opening in the sheet so that when a person actuates the actuation means, the second means releases the first means to permit the first means to inflate the balloon or balloons which break through the sheet at the scored lines when being inflated, where the balloon or balloons become fully inflated on an outer side of the sheet.

Preferably, the tray-like member is disposed on a box cover with the first and second recesses of the tray-like member being inserted into a cut out formed in the box cover. The gift or present is placed in the box bottom and covered with the box cover when the box or package is closed, and thereafter the box or package is wrapped with the gift wrap material.

BRIEF DESCRIPTION OF THE DRAWINGS

With the above and additional objects and advantages in view, as will hereinafter appear, this invention comprises the devices, combinations and arrangements of the parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
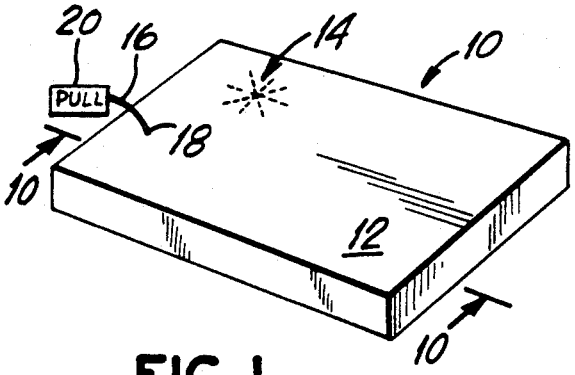
FIG. 1 is a perspective view of a gift wrapped box in accordance with the present invention.

Referring now to the drawings, FIG. 1 shows a gift wrapped box or package 10 covered with gift wrap material 12 according to the present invention.

Scored lines 14, preferably in the form of an asterisk, are formed in the material 12, being disposed adjacent to a corner of the box 10 on the top surface thereof. Additionally, actuation means in the form of a string 16 extends through an opening 18, such as a hole, in the material 12, the string 16 having a tag 20 at the end thereof. Directions or words, such as "PULL", can be printed on the tag 20.

Figure 2:
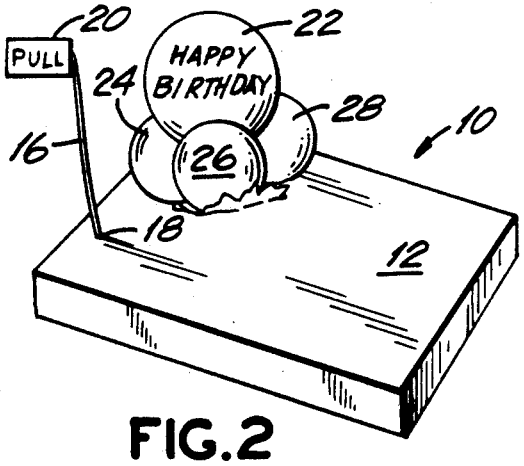
FIG. 2 is a perspective view of the gift wrapped box of FIG. 1 after the balloons have been inflated whereby the balloons have broken through the gift wrapped material.

The person receiving the gift wrapped box or package 10 pulls the tag 20 so that the string 16 is pulled out of the box 10, as shown in FIG. 2. Accordingly, as will be explained below, balloons 22, 24, 26 and 28 disposed beneath the gift wrap material 12 are inflated when the tag 20 or the string 16 is pulled, so that the balloons 22, 24, 26 and 28 break through the gift wrap material 12 at the scored lines 14 until the balloons 22, 24, 26 and 28 are fully inflated on the outside of the gift wrapped box or package 10, as shown in FIG. 2.

Figure 3:
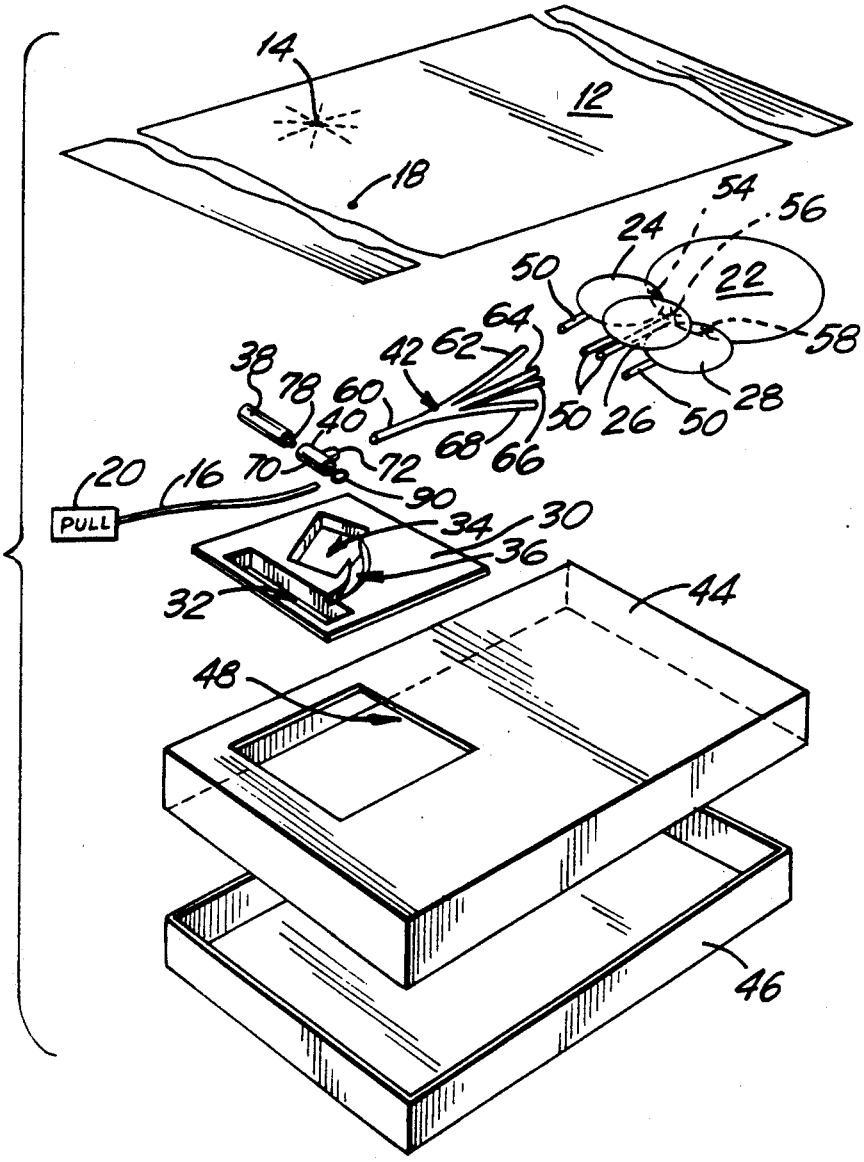
FIG. 3 is an exploded perspective view showing the parts of the gift wrapped box of FIG. 1.

As shown in FIG. 3, the present invention includes the gift wrap material 12, preferably fabricated from a thin sheet of mylar or suitable like material such as paper, having the scored lines 14 extending therethrough and the opening 18 to receive the string 16 therethrough. A tray or plate like member 30 is provided with an elongated first recess or trough 32 adjacent one side thereof, and a shallower rectangular shaped second recess 34 communicating with the first recess 32 by a passageway third recess 36, where the depth of the third recess 36 is the same as the second recess 34.

In addition to the above-mentioned string 16, the tag 20 and the balloons 22, 24, 26 and 28, the invention also includes a disposable compressed air or helium tank 38, a valve member 40 and tubing 42, as will be described in more detail below.

FIG. 3 also shows a conventional box cover 44, or top portion, and an associated mating box bottom 46, or bottom portion. It is understood that the box cover 44 and bottom 46 can be of any desired size and shape, and can be fabricated from any suitable material. The box cover 44 is provided with a cut out 48 adjacent one corner thereof, the cut out 48 having the same rectangular shape as the above-mentioned tray-like member 30, however, the cut out 48 is of a smaller size for the reasons set forth below.

Figure 4:
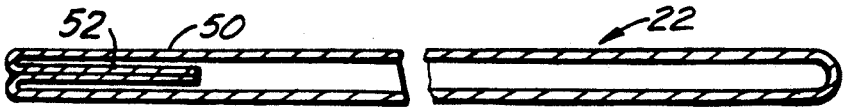
FIG. 4 is a fragmented cross-sectional view of one of the balloons.

The balloons 22, 24, 26 and 28 are preferably fabricated from a thin mylar material, or any suitable plastic or rubber-like material, where each of the balloons is provided with a stem valve-like portion 50 for inflating the balloons in a conventional manner. As shown in FIG. 4, the free-end portions 52 of the stem valve-like portions 50 are each turned into the stem valve-like portion 50 to function as a one way valve to allow the air or helium to enter the balloons, but to prevent the air or helium from escaping from the balloons once the balloons are filled.

Preferably, the balloon 22 is larger than the other balloons 24, 26 and 28, where words, such as "HAPPY BIRTHDAY" or any other suitable words for the occasion, can be printed on one or all of the balloons. It is noted, that each of the smaller balloons 24, 26 and 28 are secured by conventional means, such as an adhesive, glue, cement or like substance, to the larger balloon 22 at points 54, 56, 58, respectively, so that when the balloons are being inflated and break through the gift wrap material 12, the larger balloon 22 will pull the smaller balloons 24, 26 and 28 with it through the break in the gift wrap material 12.

The tubing 42 has a main portion 60 which branches off into several portions 62, 64, 66 and 68 for insertion into the stem valve-like portions 50 of associated ones of the balloons so that there is a branch portion 62, 64, 66, 68, for each of the balloons. It is noted, that the branch portions 62, 64, 66, 68 are inserted so that they are only half way in the free-end portions 52, thus allowing each of the free-end portions 52 to close upon itself to form the above-mentioned one way valve. The main portion 60 of the tubing 42 is inserted into the valve member 40, as described below.

Figure 5:
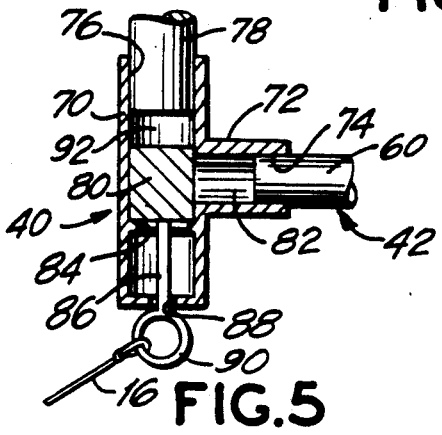
FIG. 5 is a fragmented sectional view of the valve member in the closed position before the balloons are inflated.
Figure 6:
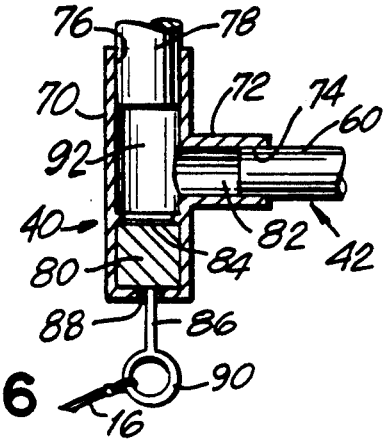
FIG. 6 is a fragmented perspective view showing the valve member of FIG. 5 in the open position so that the balloons can be inflated.

As shown best in FIGS. 5 and 6, the valve member 40 is T-shaped having an elongated portion 70 and a stem portion 72 which extends perpendicularly outwardly from a midsection of the elongated portion 70. The stem portion 72 is hollow and has an open end 74 to receive the main portion 60 of the tubing 42 therein. The elongated portion 70 is also hollow and is in flow communication with the stem portion 72. One end 76 of the elongated portion 70 is open to receive the conventional tubular valve 78 of the compressed air or helium tank 38 therein.

A plug 80 is movably disposed within the elongated portion 70, in such a manner that in a first position, it blocks the passageway 82 in the stem portion 72. The plug 80 is held in this position by a thin stop ring 84 or projection formed on the interior walls of the elongated portion 70. One end of a rod 86 is secured on the end of the plug 80, and the rod 86 extends out of the elongated portion 70 through a small opening 88 in the end of the elongated portion 70. A loop 90 or the like is secured on the opposite end of the rod 86, where the string 16 is secured in a conventional manner to the loop 90, the function of which will be described below.

In the first position of the plug 80 shown in FIG. 5, the compressed air or helium in the tank 38 exits through the tank valve 78 into the interior space 92 of the elongated portion 70 of the valve member 40 above the plug 80, and is prevented from flowing any further by the plug 80. This arrangement shown in FIG. 5 is the normal arrangement of the valve member 40 when the gift wrapped box or packaging 10, shown in FIG. 1, is forwarded and received by the person. Accordingly, when the person receives the gift wrapped box or package 10, and pulls the tag 20 so that the string 16 is pulled out of the box 10, as shown in FIG. 2, the string 16 pulls on the loop 90 so that the rod 86 is pulled out of the elongated portion 70 of the valve member 40.

During the above pulling action, the rod 86 in turn also pulls the plug 80 with it past the thin stop ring 84 to a second position at the end of the elongated portion 70 to actuate the valve member 40, as shown in FIG. 6. The compressed air or helium in the tank 38 is now free to exit from the tank valve 78 and flows from the internal space 92 into the passageway 82 in the stem portion 72, which is no longer blocked by the plug 80. Accordingly, the air or helium can now flow into the main portion 60 of the tubing 42 and into the branch portions 62, 64, 66 and 68 thereof to inflate the respective balloons connected thereto by the valve-like portions 50.

As mentioned above, during the inflation of the balloons, the balloons break through the gift wrap material 12 at the scored lines 14 until the balloons 22, 24, 26 and 28 are fully inflated on the outside of the gift wrapped box or package 12, as shown in FIG. 2.

It is noted, that the thin stop ring 84 is sufficient to maintain the plug 80 in its first position against the force of the compressed air or helium, but is not sufficient to prevent the plug 80 from being pulled past the thin stop ring 84 when the string 16 is pulled by the person receiving the gift wrapped box or package 10.

Figure 7:
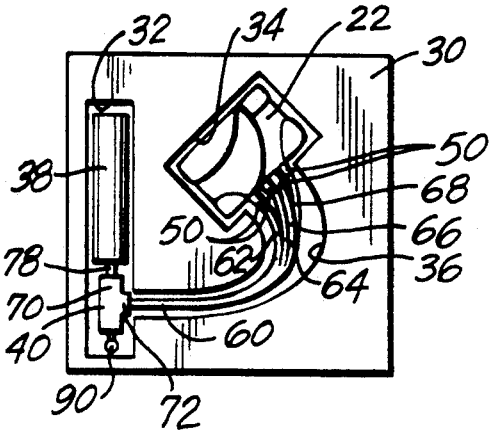
FIG. 7 is a plan view showing the tray-like member provided with recesses therein to hold the compressed air cylinder, the valve member, the tubing for the balloons and the balloons therein.
Figure 8:
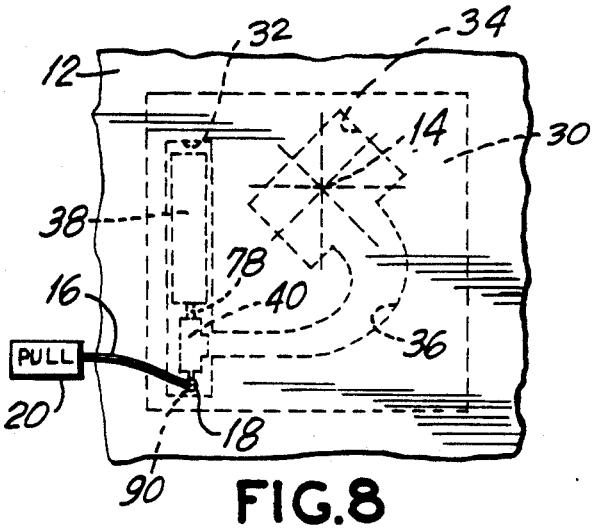
FIG. 8 is a plan view showing the tray-like member of FIG. 7 covered with the sheet of gift wrap material.

Referring now to FIGS. 7 and 8, the assembly of the present invention will now be discussed. The branch portions 62, 64, 66 and 68 of the tubing 42 are inserted into the associated valve-like portions 50 of the balloons, extending approximately half way into the free-end portions 52 of the balloons for the reason mentioned above. The main portion 60 of the tubing 42 is then inserted into the stem portion 72 of the valve member 40. Additionally, the valve 78 of the compressed air or helium tank 38 is inserted into the open end 76 of the elongated portion 70 of the valve member 40, where the plug 80 of the valve member 40 is in the first position blocking the passageway 82 in the stem portion 72, as shown in FIG. 5.

The tank 38 and the valve member 40 are now positioned in the recess 32 of the tray-like member 30, the tubing 42 is inserted in the recess 36 of the tray-like member 30, and the balloons are positioned in the recess 34 of the tray-like member 30. The balloons 22, 24, 26 and 28 are now folded, preferably first in an accordian like manner and then in thirds, to fit within the recess 34 as shown in FIG. 7.

The sheet of material 12 is now positioned over the tray like member 30 with the scored lines 14 being disposed above the recess 34 of the tray-like member 30, and the opening 18 in the sheet of material 12 being disposed over one end of the recess 32 of the tray-like member 30, as shown in FIG. 8, where the spacing between the scored lines 14 and the opening 18 are predetermined to permit the above positioning thereof.

The free end of the string 16 is passed through the opening 18 from the outside thereof, and the free end of the string 16 is tied in a conventional manner to the loop 90. Preferably, the sheet of material 12 is now secured to the surface of the tray-like member 30, using suitable conventional means, such as an adhesive, glue, cement and the like, as shown in FIG. 8. The sheet of material 12 and the tray-like member 30 and the contents therein are now assembled to form a unitary structure for gift wrapping the box or package 10.

Figure 9:
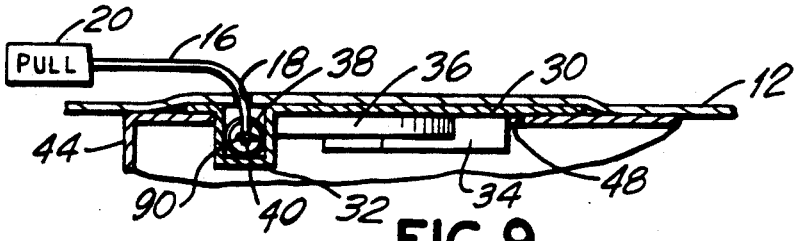
FIG. 9 is a fragmented cross-sectional view showing the sheet of gift wrap material and the tray-like member of FIG. 8 positioned on the box.

As shown in FIG. 9, the sheet of material 12 and the tray-like member 30 are now positioned on the box cover 44 so that the recesses 32, 34, 36 of the tray-like member 30 are inserted into the cut out 48 in the box cover 44. The underside portions of the peripheral edges of the tray-like member 30 are disposed on the wall surfaces around the cut out 48 of the box cover 44. Preferably, portions of the recesses 32 and 34 are disposed adjacent to the edges of the cut out 48 of the box cover 44 to prevent sliding of the tray-like member 30 therein, where if desired, the peripheral edges of the tray-like member 30 can be secured by conventional means, such as an adhesive, glue, cement, and the like, to the wall surfaces around the cut out 48.

Figure 10:
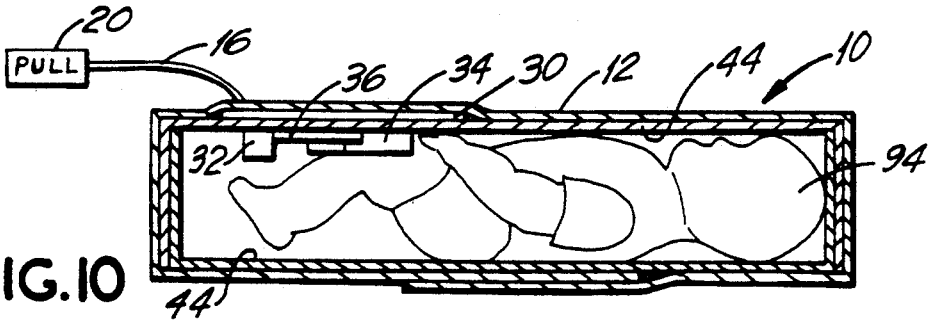
FIG. 10 is a cross-sectional view taken along line 10—10 of FIG. 1.

As shown in FIG. 10, a gift such as a doll 94 is placed within the box bottom 46, and the box cover 44 is placed over the box bottom 46 to close the box. The remaining portion of the sheet of material 12 is now used to wrap the box or package 10 in a conventional manner. The gift wrapped box or package 10 can now be delivered to a particular person for a particular occasion so that the particular person receiving the gift wrapped box 10 is pleasantly surprised when, after pulling the tag 20, the balloons 22, 24, 26 and 28 break through the gift wrap material 12 at the scored lines 14 as the balloons are being inflated.

Numerous alterations of the structures herein discussed will suggest themselves to those skilled in the art. However, it is to be understood that the present disclosure relates to a preferred embodiment of the invention which is for the purpose of illustration only, and is not to be construed as a limitation of the invention.

What is claimed is:

1. A gift wrap material for wrapping boxes and packages, comprising:

a sheet of material having a portion provided with scored lines, and an opening provided in said sheet spaced from said portion;

a tray member secured to an underside portion of said sheet to provide unitary structure means for gift wrapping a box containing a gift therein, so that said tray member can be inserted into a cut out provided in one surface of the box when the box is being wrapped with said sheet;

said tray member having at least first and second recesses therein, said first recess being disposed under said portion provided with said scored lines;

at least one balloon being disposed in said first recess in a deflated condition;

first means for inflating said balloon being disposed in said second recess;

second means connecting said ballon in flow communication with said first means;

third means for releasing said first means so that said first means can inflate said balloon; and actuation means connected to said third means and extending through said opening in said sheet so that when a person actuates said actuation means, said third means releases said first means to permit said first means to inflate the balloon which breaks through said scored lines in said sheet when being infalted, said balloon becoming fully inflated on an outer side of said sheet outside the wrapped box.

2. A gift wrap material according to claim 1, wherein said third means is disposed in said second recess, and said opening in said sheet is disposed over said second recess.

3. A gift wrap material according to claim 1, wherein said third means is a valve member having a movable plug therein, said plug in a first position blocks said flow communication between said first means and said balloon, said plug in a second position permits said flow communication between said first means and said balloon.

4. A gift wrap material according to claim 3, wherein said valve member is disposed in said second recess.

5. A gift wrap material according to claim 3, wherein a loop disposed outside said valve member is connected to said plug, said actuation means being connected to said loop.

6. A gift wrap material according to claim 5, wherein said actuation means is a string having one end connected to said loop.

7. A gift wrap material according to claim 6, wherein a tag is connected to an opposite end of said string, said tag being disposed adjacent to said outer side of said sheet outside the wrapped box.

8. A gift wrap material according to claim 1, wherein said first means is a compressed air or helium tank.

9. A gift wrap material according to claim 1, including more than one balloon disposed in said first recess.

10. A gift wrap material according to claim 9, including four balloons disposed in said first recess.

11. A gift wrap material according to claim 10, wherein one of said four balloons is larger than the other three balloons.

12. A gift wrap material according to claim 11, wherein said other three balloons are each connected to said one larger balloon so that said one larger balloon pulls said other three balloons through said scored lines when breaking through said sheet.

13. A gift wrap material according to claim 9, wherein said second means includes tubing, said tubing having a main portion branching off into branch portions, said main portion being connected to said third means, and each of said branch portions being connected to an associated one of said balloons.

14. A gift wrap material according to claim 13, wherein said third means is a valve member.

15. A gift wrap material according to claim 13, wherein each of said balloons includes a stem portion for receiving an associated one of said tubing branch portions therein, each said stem portion having a one way valve therein to only permit said flow communication into a respective one of said balloons.

16. A gift wrap material according to claim 1, wherein said balloon includes a stem portion for receiving a portion of said second means therein, said stem portion having a one way valve therein to only permit said flow communication into said balloon so that said balloon remains inflated after being filled.

17. A gift wrap material according to claim 1, wherein said first and second recesses of said tray member are inserted into the cut out provided in said one surface of the box with underside portions of peripheral edges of said tray member being disposed on box wall surfaces around said cut out.

18. A gift wrap material according to claim 1, wherein said actuation means is a string having one end connected to said third means.

19. A gift wrap material according to claim 18, wherein a tag is connected to an opposite end of said string, said tag being disposed adjacent to said outer side of said sheet outside the wrapped box.

* * * * *